US005515846A

United States Patent [19]

Drews

[11] Patent Number: 5,515,846

[45] Date of Patent: May 14, 1996

[54] RESPIRATOR WITH A BREATHING FILTER

[75] Inventor: Ralf Drews, Lübeck, Germany

[73] Assignee: Drägerwerk AG, Lübeck, Germany

[21] Appl. No.: 456,505

[22] Filed: Jun. 1, 1995

[30] Foreign Application Priority Data

Dec. 6, 1994 [DE] Germany ..... 44 43 299.2

[51] Int. Cl.[6] ..... A62B 18/02; A62B 18/08; A62B 23/02

[52] U.S. Cl. ..... 128/206.28; 128/201.25; 128/206.12

[58] Field of Search ..... 128/201.22–201.25, 128/205.27–205.29, 206.12, 206.16, 206.17, 206.28

[56] References Cited

U.S. PATENT DOCUMENTS

| | | | |
|---|---|---|---|
| 2,375,147 | 5/1945 | Teague | 128/207.11 |
| 2,382,364 | 8/1945 | Yant | 2/428 |
| 2,827,900 | 3/1958 | Marietta | 128/207.11 |
| 4,029,092 | 6/1977 | Morgan | 128/207.11 |
| 4,352,353 | 10/1982 | Bolton et al. | 128/201.23 |
| 4,562,837 | 1/1986 | Schlobohm | 128/206.17 |
| 5,148,803 | 9/1992 | Schlobohm . | |

FOREIGN PATENT DOCUMENTS

| | | | |
|---|---|---|---|
| 3236028 | 3/1984 | Germany | 128/206.12 |
| 4020127C1 | 10/1991 | Germany | A62B 18/08 |

*Primary Examiner*—Edgar S. Burr
*Assistant Examiner*—Dan Colilla
*Attorney, Agent, or Firm*—McGlew and Tuttle

[57] ABSTRACT

A respirator including a mask body with a breathing filter at a breathing connection of the mask body, with a cuff accommodating the breathing filter and with a bellows, which seals the mask interior against the environment. The bellows is connected to the cuff and to the mask body. The breathing filter is locked in the position of use based on the bellows being made in one piece with the breathing connection, as a continuation of the mask body. The bellows surrounds the cuff in the manner of a truncated cone, in at least one partial section of the extent of the breathing filter.

9 Claims, 2 Drawing Sheets

RESPIRATOR WITH A BREATHING FILTER

FIELD OF THE INVENTION

The present invention pertains to a respirator with a mask body, with a breathing filter on a breathing connection of the mask body, with a cuff accommodating the breathing filter, and with a bellows made of an elastic material, which seals the interior of the mask against the environment and is connected to the cuff and to the mask body.

BACKGROUND OF THE INVENTION

A respirator with a breathing filter, which is displaceable within a breathing connection and is connected to the mask body via a bellows has become known from DE 40 20 127 C1. The bellows surrounds the breathing filter in the form of a cuff and seals the interior of the mask in the area of the breathing filter against the environment. A guide ring made of a solid material is used to push the breathing filter into the interior of the mask together with the cuff. The guide ring is provided within the breathing connection. The cuff slides along the inner side of the guide ring. To improve the sliding properties, the cuff is provided, in the manner of a sleeve, with a sliding strip made of Teflon. To fix the breathing filter in the position of use, a sealing lip, which presses the outside of the cuff on all sides, is arranged on the breathing connection.

The disadvantage of the prior-art respirator is the fact that it is not possible to recognize from the outside whether the breathing filter has been completely pushed out of the mask body. Even though the length of the pushing movement is limited by the bellows, an impact on the breathing filter may cause the breathing filter to be partially displaced in the direction of the interior of the mask before the respirator is put on. This is because the fixation of the breathing filter in the position of use depends essentially on the force of the pressure of the sealing lip at the breathing connection on the cuff of the breathing filter. Moreover, the prior-art respirator is expensive to manufacture, because the sliding ring and the sliding strip also must be mounted on the rubber molding of the mask body.

SUMMARY AND OBJECTS OF THE INVENTION

The primary object of the present invention is to improve the respirator of the type described in terms of the possibility of locking the breathing filter in the position of use.

To attain this object, the bellows is made in one piece with the breathing connection as a continuation of the mask body, and the bellows surrounds the cuff, in at least one partial section of the longitudinal (axial dimension) of the breathing filter, in the manner of a truncated cone.

The advantage of the present invention is essentially the fact that the bellows is located outside the mask body and surrounds the circumference of the breathing filter in the manner of a truncated cone, and whether the breathing filter has been completely pushed out into the position of use can therefore be immediately recognized from the outside from the contour of the bellows. In addition, the breathing filter is better supported in the position of use against the mask body by the truncated cone shape of the body of the bellows originating from the breathing connection. Due to the stable body shape of the bellows, which is a result of the truncated cone geometry, the bellows always resumes the truncated cone shape upon axial or radial impacts on the breathing filter. Due to the truncated cone shape of the bellows, there is inherently a clearance because of the differences in the diameters of the cuff and the breathing connection, as a result of which the pushing out of the breathing filter is facilitated and sliding surfaces between the breathing connection and the cuff are not necessary any longer. In addition, a respirator with a truncated cone-shaped bellows made in one piece with the breathing connection and pointing toward the outside of the mask can also be manufactured in a simple manner in terms of molding technology, so that low-cost manufacture is possible.

The length of the bellows is advantageously selected to be such that it extends over the entire longitudinal (axial) dimension of the breathing filter up to a filter inlet of the breathing filter and is continued from there as a cuff folded around in the direction of the interior of the mask. The breathing filter can then be snugly fit directly in the cuff.

The internal diameter of the breathing connection and the external diameter of the cuff are preferably selected to be such that an annular gap-shaped intermediate space is formed, in which the bellows is accommodated in the manner of a loop with the breathing filter pushed into the interior of the mask.

A protective hood fastened to the breathing connection is advantageously placed as a jacketing over the bellows. Since such protective hoods are used in a pollutant-containing, corrosive surrounding atmosphere, covering the bellows with the protective hood prevents the surrounding atmosphere from having access to the material of the bellows.

The protective hood is advantageously fixed on the bellows by means of a filter cover pushed onto the bellows in the area of the filter inlet.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
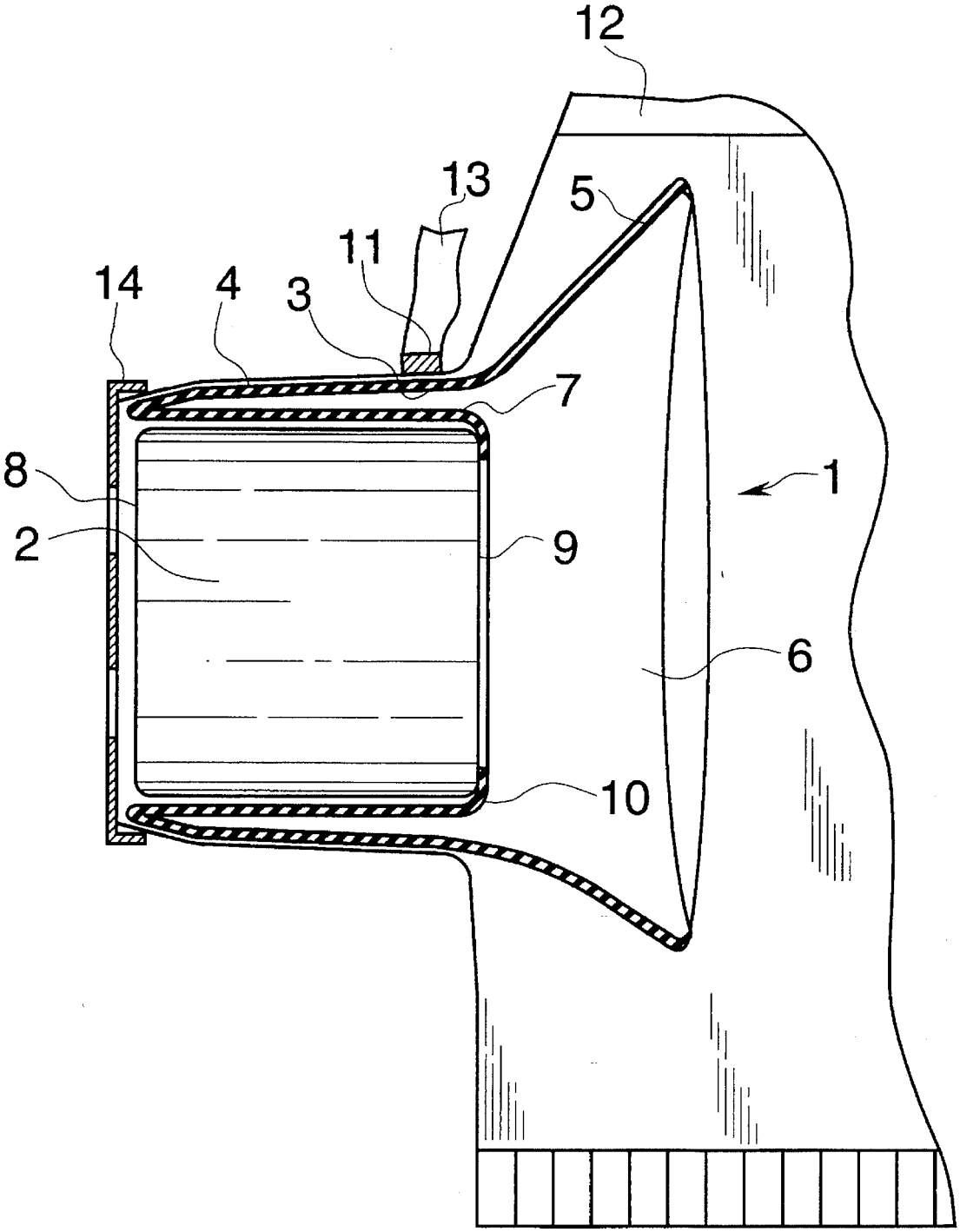
FIG. 1 is a schematic cross sectional view of a respirator according to the invention with the breathing filter pushed out, in a position for use.

FIG. 1 shows the longitudinal section through the respirator 1 with a breathing filter 2 at a breathing connection 3 of a mask body 5. The breathing connection 3 is joined in one piece by a bellows means 4 made of an elastomeric material. The bellows 4 surrounds the breathing filter 2 and includes a portion in the shape of a truncated cone. The bellows 4 is folded over in the direction of the mask body 5 of the respirator 1 to form a cuff 7. The cuff 7 accommodates the breathing filter 2 at a filter inlet or filter inlet side 8 of the breathing filter 2. The mask body 5 surrounds a mask interior 6. The bellows 4 is part of the mask body 5 and seals the mask interior 6 in the area of the breathing filter 2 against the environment. With its filter outlet or filter outlet side 9, the breathing filter 2 comes into contact with a collar 10 of the cuff 7. A protective hood 12 and a harness 13 with a strap 11 are fastened to the breathing connection 3. A portion of the hood 12 is placed over the bellows 4 and is fixed at the filter inlet 8 with a filter cover 14.

The protective hood 12 can be pulled over the head of a mask user, not shown in FIG. 1. Since such protective hoods can also be used in a pollutant-containing, corrosive surrounding atmosphere, the surrounding atmosphere is prevented by the covering of the bellows 4 from having access to the material of the bellows.

Figure 2:
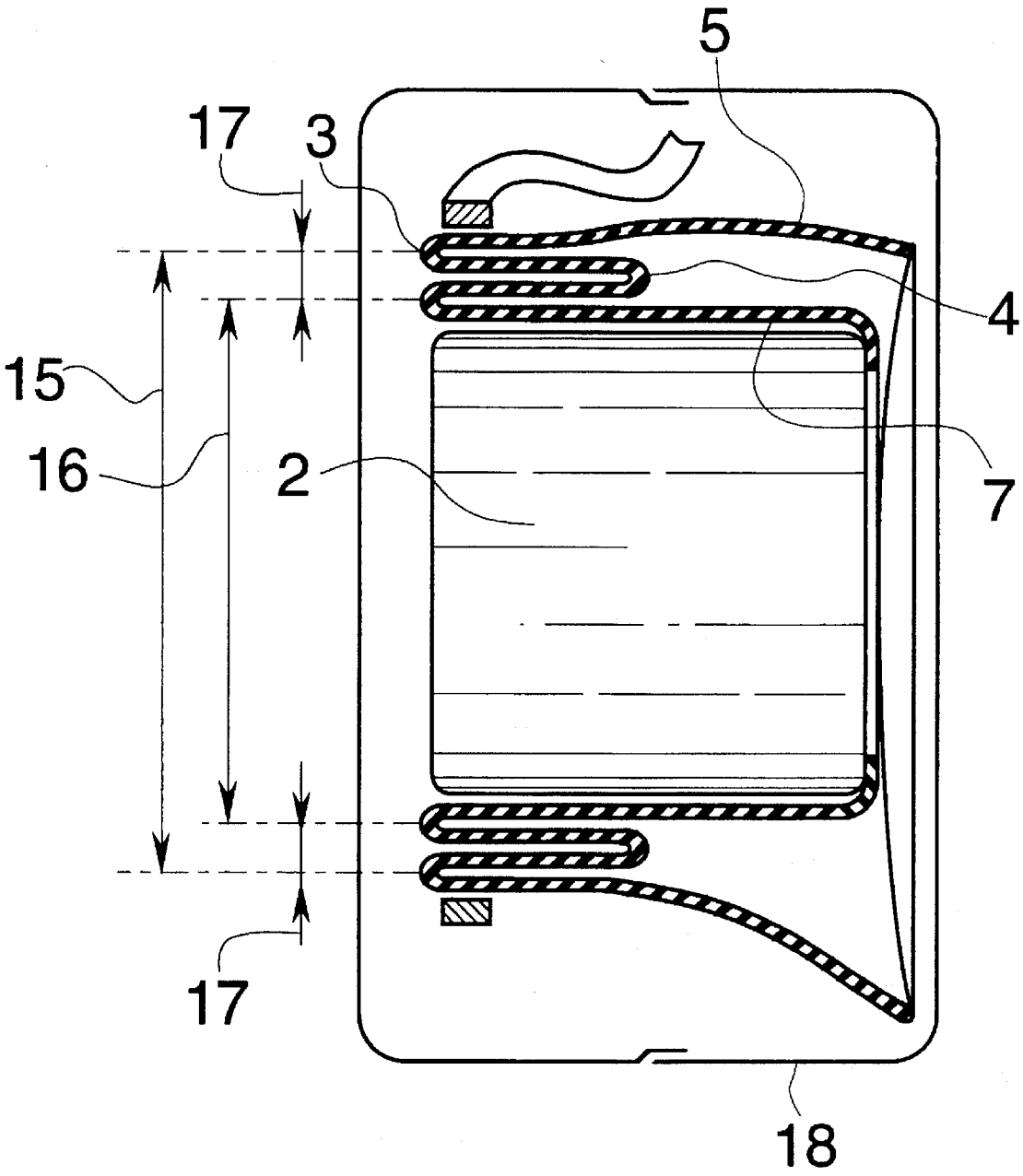
FIG. 2 is a schematic cross sectional view of a respirator with the breathing filter pushed into the carrying container.

FIG. 2 shows the respirator 1 according to FIG. 1 with the breathing filter 2 pushed into the mask interior 6. The respirator 1 of FIG. 1 is located in a carrying container 18. The internal diameter 15 of the breathing connection 3 and the external diameter 16 of the cuff 7 are selected to be such that the bellows 4 is accommodated, in the manner of a loop, in an intermediate space 17, which is formed by the difference between the diameters 15, 16. The hood 12 and the filter cover 14 of FIG. 1 are not shown in FIG. 2 for the sake of better clarity.

While a specific embodiment of the invention has been shown and described in detail to illustrate the application of the principles of the invention, it will be understood that the invention may be embodied otherwise without departing from such principles.

What is claimed is:

1. A respirator, comprising:

a mask body with a mask body breathing connection, said mask body defining a mask interior;

a breathing filter, the breathing filter being disposed at the mask body breathing connection and having an axis extending centrally of said filter in the direction of air passing through said filter;

a cuff accommodating said breathing filter; and a bellows connected to said cuff and connected to said mask body, defining a seal for sealing said mask interior against the environment, said bellows being dimensioned to extend over the entire extent of said breathing filter up to a filter inlet of said breathing filter, said bellows continuing from said filter inlet as said cuff, said bellows being folded over in a direction substantially parallel to said axis, and being formed of an elastomeric material, said bellows being made in one piece with said breathing connection, the one piece forming a continuation of said mask body, said bellows surrounding said cuff in a truncated cone-shaped manner.

2. A respirator in accordance with claim 1 wherein said breathing connection has a connection external dimension and said cuff has a cuff external dimension, said connection external dimension and said cuff external dimension being provided to define an annular gap-shaped intermediate space, whereby said bellows is accommodatable in a loop-shaped position, within said intermediate space with said breathing filter pushed into said mask interior.

3. Respirator in accordance with claim 2 wherein a protective hood is fastened to said breathing connection to provide jacketing over said bellows.

4. A respirator in accordance with claim 1 wherein a protective hood is fastened to said breathing connection to provide jacketing over said bellows.

5. Respirator in accordance with claim 4 including a filter cover, wherein said protective hood is fixed on said bellows by means of said filter cover pushed onto said bellows in an area of a filter inlet of said breathing filter.

6. A respirator in accordance with claim 1, wherein:

said bellows means has a truncated cone shape.

7. A respirator in accordance with claim 1, wherein:

said bellows means biases said filter in a position out of said mask interior.

8. A respirator in accordance with claim 1, wherein:

said filter has a filter inlet side;

said bellows means is connected to said filter at said filter inlet side, and said bellows means folds back on itself when said filter is moved into said mask interior.

9. A respirator in accordance with claim 1, wherein:

said breathing connection has an internal diameter and said filter has an external diameter to define a gap;

said bellows means folds back on itself and is positioned in said gap when said filter is moved into said mask interior.

* * * * *